US006350045B1

(12) United States Patent
Pearce

(10) Patent No.: US 6,350,045 B1
(45) Date of Patent: Feb. 26, 2002

(54) LIGHT FIXTURE HAVING A QUICK CONNECT LIGHT SHADE

(75) Inventor: Richard A. Pearce, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/637,749

(22) Filed: Aug. 11, 2000

(51) Int. Cl.[7] ..... F21V 17/00
(52) U.S. Cl. ..... 362/363; 362/389; 362/438
(58) Field of Search ..... 362/96, 363, 374, 362/375, 389, 396, 408, 433, 437, 438, 439, 440, 441, 446, 448, 452, 453

(56) References Cited

U.S. PATENT DOCUMENTS

| | | | | |
|---|---|---|---|---|
| 1,008,344 A | | 11/1911 | Larzelere | |
| 1,089,869 A | | 3/1914 | Ripley | |
| 1,114,522 A | * | 10/1914 | Reutter | 362/437 |
| 1,710,730 A | * | 4/1929 | Guth | 362/437 |
| 1,746,339 A | | 2/1930 | Doane | |
| 1,753,880 A | * | 4/1930 | Curtis | 362/437 |
| 1,769,481 A | | 7/1930 | Zahm | |
| 1,906,608 A | * | 5/1933 | Jaffe | 362/437 |
| 3,108,753 A | | 10/1963 | Coffey | 240/128 |
| 3,524,981 A | | 8/1970 | Auerbach | 240/128 |
| 4,099,224 A | | 7/1978 | Valpey | 362/433 |
| 4,175,282 A | | 11/1979 | Grindle et al. | 362/363 |
| 4,428,032 A | | 1/1984 | Workman | 362/96 |
| 4,754,383 A | | 6/1988 | Klaus | 362/363 |
| 4,764,855 A | | 8/1988 | Fretz, III et al. | 362/433 |
| 5,034,869 A | | 7/1991 | Choi | 362/363 |
| 5,491,618 A | | 2/1996 | Vakil | 362/147 |

OTHER PUBLICATIONS

Bel Air™ Owner's Manual, 1996, front and back cover pages and page 7.
Magno, Jr. et al., co–pending U.S. application No. 09/464,187, entitled "Light Fixture For a Ceiling Fan," in its entirety.

* cited by examiner

*Primary Examiner*—Y. My Quach-Lee
(74) *Attorney, Agent, or Firm*—Baker, Donelson, Bearman & Caldwell

(57) ABSTRACT

A light fixture is provided which includes an annular fitter having inner and outer surfaces, with the inner surface defining a hollow interior, and the fitter further including an open first end. The fixture further includes a substantially annular retention member disposed within the fitter, with retention member including a substantially annular base portion having radially inner and outer surfaces, with the radially outer surface being disposed in contacting engagement with the inner surface of said fitter. The retention member further includes a plurality of circumferentially spaced springs integral with the base and protruding therefrom and a plurality of circumferentially spaced circumferential stops integral with the base and protruding therefrom. The light fixture further includes a light shade having a neck and a light emitting enclosure integral with the neck. The neck includes a first lobed portion having a proximal end integral with the light-emitting enclosure and a distal end. The neck further includes a lobed flange integral with the distal end. The neck further includes a lobed flange integral with the distal end of the first lobed portion of the neck. The neck of the light shade and the retention member cooperate with one another to permit a user to insert the neck of the light shade through the open end of the fitter to the hollow interior of the fitter, and then to rotate the light shade from an unlocked position into a locked position.

12 Claims, 19 Drawing Sheets

LIGHT FIXTURE HAVING A QUICK CONNECT LIGHT SHADE

BACKGROUND 1.0 Field of the Invention

The present invention relates generally to light fixtures and, more particularly to light fixtures incorporating a quick connect light shade. The light fixture of the present invention may advantageously be used in a wide variety of applications. For instance, the light fixture of the present invention may be used in conjunction with ceiling fans, comprise a ceiling-mounted light fixture or wall-mounted sconce, or may comprise a portion of a desk or table lamp.

2.0 Related Art

Conventional light fixtures typically include a fitter secured to a mount arm or other support structure and a light shade having a neck portion which is retained in position within the fitter. The light shade is disposed in surrounding relationship with a light source such as an incandescent bulb. A wide variety of fitter shapes are known in the art, including generally bell-shaped hollow housings which may be supported by a portion of a ceiling fan, or alternatively may be mounted directly to a ceiling or wall or be supported by a portion of a desk or table lamp. The light shades of many ceiling fan light fixtures and overhead light fixtures are typically retained in one of the following two ways. A plurality of circumferentially spaced screws may be used, with the screws protruding radially inwardly through holes formed around the periphery of the fitter, until they are in contacting engagement with the neck portion of the light globe. The light globe is then retained in place by the friction created by the contacting engagement between the mount screws and the neck portion of the light shade. This approach is also used in conventional light fixtures which are part of a table or desk lamp. In other conventional ceiling-mounted light fixtures, the neck portion of the light shade includes a helical threaded portion which engages protuberances in an annular flange of the fitter.

Both of the foregoing conventional light fixtures are subject to various disadvantages, particularly when the light fixtures are used in conjunction with a ceiling fan or are mounted overhead to a ceiling. For instance, it is somewhat awkward to handle the relatively small screws required and install them through the fitter into contacting engagement with the light shade, while reaching overhead or working from a ladder. Additionally, this installation scheme may result in the light shade being off center somewhat relative to the remainder of the fixture. Furthermore, when such conventional light fixtures are used in conjunction with a ceiling fan, the light shade is subject to disengagement from the fitter during operation of the ceiling fan as a result of the mounting screws becoming loose due to ceiling fan vibration. Similarly, with regard to conventional ceiling fan light fixtures using helical threads on the light shade, ceiling fan vibration during operation may cause the shade to back off or rotate out of the fitter and therefore fall to the floor.

Various devices have been used to allow light shades to be rotated into a "locked" position during installation with these devices including those incorporating resilient members such as springs. However, there are various disadvantages associated with known devices of this type. For instance, with some known devices of this type, it is difficult for the user to determine by "feel" when the shade is in a locked, installed position. Furthermore, with some known devices of this type, the locking feature may be viewable by an observer positioned below the light fixture, which is undesirable. Also, many devices of this type are complex and therefore costly, requiring multiple components which may be difficult to manufacture. Furthermore, many of devices of this type which are available in the light fixture art in general, may not be suitable for use in applications such as a ceiling fan since the "locking" feature may not be sufficient to retain the shade or globe to the fixture due to the vibration of the ceiling fan. Furthermore, in ceiling fan applications, many known light fixtures include light shades which are loose or rattle within the fitter during operation of the fan thereby transmitting undesirable noise.

In view of the foregoing deficiencies associated with known light fixtures, there remains a need for a simple, easy to install and reliable light fixture which is suitable for multiple applications.

SUMMARY

In view of the foregoing needs, the present invention is directed to a simple, easy to install and reliable light fixture having a quick connect light shade, which is suitable for a wide variety of applications. For instance, the light fixture of the present invention may be used in conjunction with a ceiling fan, may comprise an overhead, ceiling-mounted light fixture, may comprise a portion of a desk or table lamp, or may comprise a wall-mounted sconce. The configuration of the included light shade, fitter and retention member disposed within the fitter, permit the user to secure the shade within the fitter in a simple manner, including "blind" installations, and allows the user to "feel" when the shade is in a locked position, upon rotation of the light shade. The springs which are included in the retention member significantly reduce or eliminate noise transmission and the combined locking features of the light shade and retention member allow the light fixture to be used in a vibration environment, such as that associated with a ceiling fan in operation.

According to a preferred embodiment, the light fixture according to the present invention includes an annular fitter having inner and outer surfaces, with the inner surface defining a hollow interior and the fitter further including an open first end and a second end having an aperture extending therethrough. The light fixture further includes a substantially annular retention member disposed within the fitter, with the retention member including a substantially annular base portion having a radially inner surface and a radially outer surface which is disposed in contacting engagement with the inner surface of the annular fitter. The retention member further includes a plurality of circumferentially spaced springs integral with the base and protruding therefrom and a plurality of circumferentially spaced circumferential stops integral with the base and protruding therefrom.

The light fixture further includes a light shade having a neck and a light-emitting enclosure integral with the neck. The neck includes a first lobed portion having a proximal end integral with the light emitting enclosure and a distal end. The neck further includes a lobed flange integral with the distal end of the first lobed portion of the neck. The neck of the light shade and the retention member cooperate with one another to permit a user to insert the neck of the light shade through the open end of the fitter into the hollow interior of the fitter and then to rotate the light shade from an unlocked position into a locked position. The particular configuration of the neck of the light shade and the retention member combine to provide an identifiable "feel" to the user when the shade passes from the unlocked to the locked position. Furthermore, the circumferential stops and the neck of the light shade combine with one another to substantially prevent the user from "over-rotating" the light shade past the locked position and the circumferential stops and neck further combine to prevent the user from rotating the light shade in an incorrect direction of rotation during installation.

The fitter includes an annular ring portion disposed proximate the open end of the fitter, with the retention member being disposed within the annular ring portion of the fitter. Additionally, the annular fitter may include a plurality of circumferentially spaced apertures formed therein which are effective for receiving a like number of circumferentially spaced anti-rotation tabs, which may be provided, with the tabs protruding from the substantially annular base portion of the retention member, so as to substantially prevent the retention member from rotating relative to fitter. Alternatively, the retention member may be secured in position within the fitter by other means. For instance, in other embodiments the retention member may be welded to the fitter and various other devices, other than anti-rotation tabs, may be provided to prevent rotation of the retention member relative to the fitter. The annular fitter further includes a second end having an aperture extending therethrough.

In one preferred embodiment, the substantially annular base portion, the springs and the circumferential stops of the substantially annular retention member are made as a one-piece construction. However, in other embodiments, the base portion, springs and circumferential stops may be made separately and attached to one another.

Each of the springs of the retention member is radially spaced from the first lobed portion of the neck when the light shade is in an unlocked position. However, when the light shade is in a locked position, each of the springs are disposed in contacting engagement with the first lobed portion of the neck. More particularly, the first lobed portion of the neck includes a plurality of radially outwardly extending lobes, with each of the lobes including an apex portion, and each of the springs of the retention member being disposed in contacting engagement with the apex portion of one of said lobes when the light shade is disposed in the locked position. In one preferred embodiment, the first lobed portion of the neck includes three of the radially outwardly extending lobes, which are substantially equally spaced from one another, and the retention member includes three of the springs which are substantially equally spaced from one another. Alternatively, other quantities of springs and lobes may be provided, as long as a like number of springs and lobes are provided.

In one preferred embodiment, each of the springs includes a substantially cylindrical proximal portion, a substantially cylindrical distal portion and an intermediate portion interconnecting the proximal and distal portions, with the proximal portion being integral with the base portion of the retention member. The distal portion of each of the springs is disposed in contacting engagement with the apex portion of one of the lobes of the first lobed portion of the neck when the light shade is disposed in the locked position. The distal portion and intermediate portion of each of the springs are tapered longitudinally relative to the proximal portion of the spring.

The lobed flange of the neck includes a plurality of radially outwardly extending lobes, with each of the lobes having an apex portion disposed radially outwardly of the first lobed portion of the neck. The circumferential stops are longitudinally aligned with the lobed flange and each of the circumferential stops is disposed proximate the apex portion of one of the lobes of the lobed flange is in the locked position. Each of the circumferential stops is disposed circumferentially between an adjacent pair of the springs of the retention member.

BRIEF DESCRIPTION OF THE DRAWINGS

These and other features, aspects and advantages of the present invention will become better understood with regard to the following description, appended claims and accompanying drawings, wherein:

DETAILED DESCRIPTION

Figure 1:
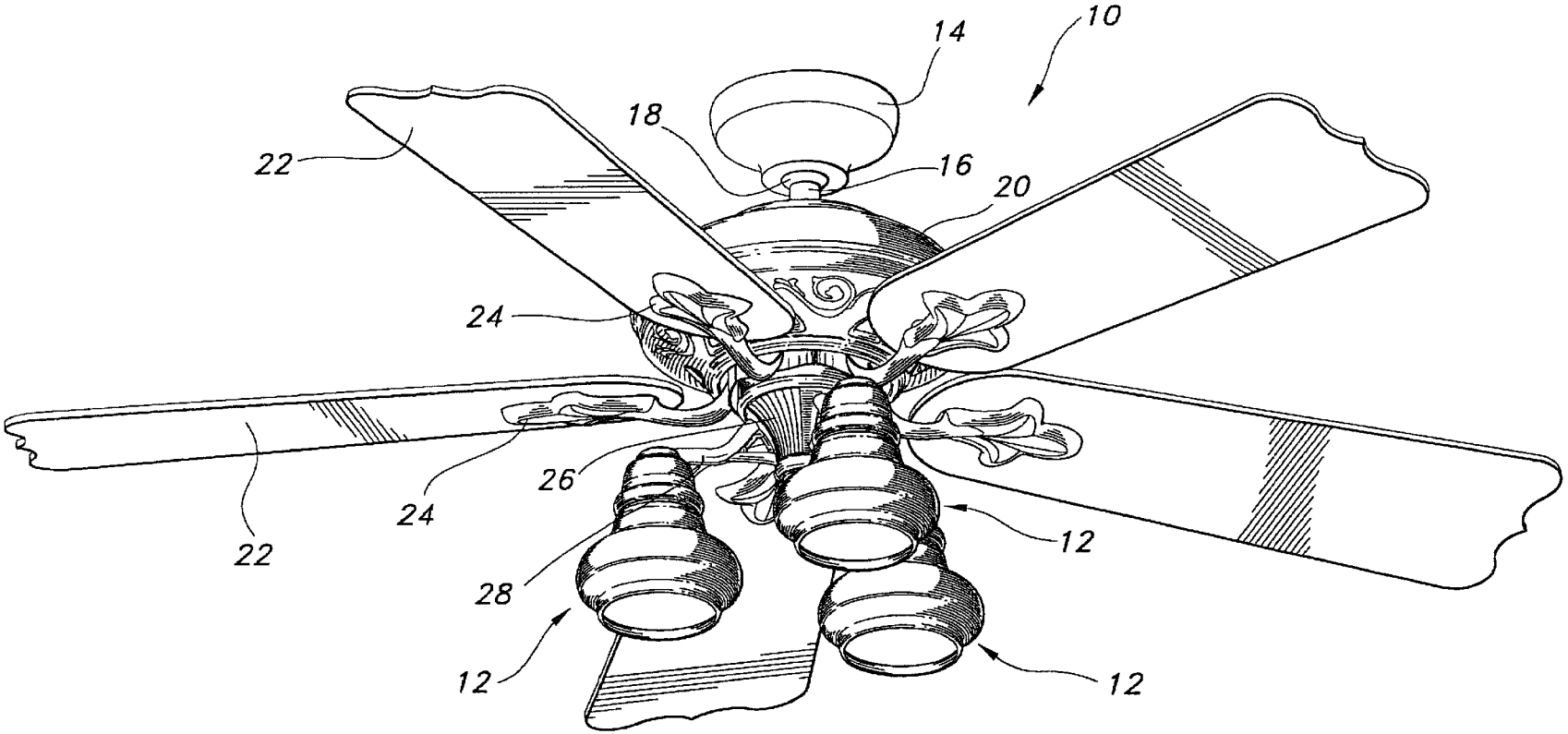
FIG. 1 is a perspective view illustrating a ceiling fan incorporating a light fixture according to the present invention.

Referring now to the drawings, wherein like reference numerals have been used for similar elements throughout, FIG. 1 is a perspective view illustrating a ceiling fan 10 which incorporates a plurality of light fixtures 12 according to the present invention. It should be understood that the particular features of ceiling fan 10 do not form a part of the present invention and are shown by way of illustration, not of limitation.

Ceiling fan 10 may be suspended from a ceiling (not shown) of a residential or commercial structure, by a canopy 14 and downrod 16 arrangement, as well known in the art. A ball 18 is affixed to an upper end of the downrod 16 and is pivotally disposed within a seat (not shown) formed in the canopy 14 to allow the ceiling fan 10 to pivot somewhat, for instance to accommodate a vaulted or sloped ceiling. The downrod 16 supports an electric motor (not shown) which typically comprises an "inside-out" motor, with the included stator (not shown) being disposed radially outwardly of the rotor of the motor. Alternatively, ceiling fan 10 may include a "standard configuration" motor with the stator disposed radially outwardly of the rotor. The downrod 16 is typically attached at a lower end to an adapter (not shown) which is connected to the stator, thereby providing support to the motor.

Ceiling fan 10 further includes a decorative fan housing 20 disposed in surrounding relationship with the electric motor of fan 10, the fan housing 20 being attached to the adapter secured to downrod 16. Ceiling fan 10 further includes a plurality of fan blades 22 which are rotatably connected to a rotating portion of the electric motor of fan 10, for rotation therewith, via blade irons 24. Additionally, ceiling fan 10 includes a switch housing 26 which is disposed below the stationary fan housing 20 and may be supported by a lower end of the stator shaft (not shown) of the included electric motor. The switch housing 26 typically contains electrical wires (not shown) which are connected to the source of electrical power in the residential or commercial structure in which ceiling fan 10 is suspended, and conventional switches (not shown) which are known in the art to control the operation of fan 10, including the speed and direction of the included electric motor and fan blades 22. The electrical wires comprising the source of electrical power in the structure are typically routed to a junction box, and may then be spliced with wires contained within the hollow canopy 14. These wires are then routed downward through the canopy 20, the hollow downrod 16, and the hollow stator shaft of the included electric motor. The electric wires exit from the lower end of the stator shaft of the motor into the interior of the switch housing 26 and may then be connected to the various included switches as required to control operation of the ceiling fan 10.

Ceiling fan 10 further includes a plurality of hollow support arms 28, with each of the support arms 28 extending from the switch housing 26 to one of the light fixtures 12 of the present invention, thereby providing support for light fixture 12. Furthermore, the necessary electrical wires are routed from switch housing 26 through hollow support arms 28 to light fixtures 12, so as to provide electrical power to the light sources (not shown) disposed within light fixtures 12.

Figure 2:
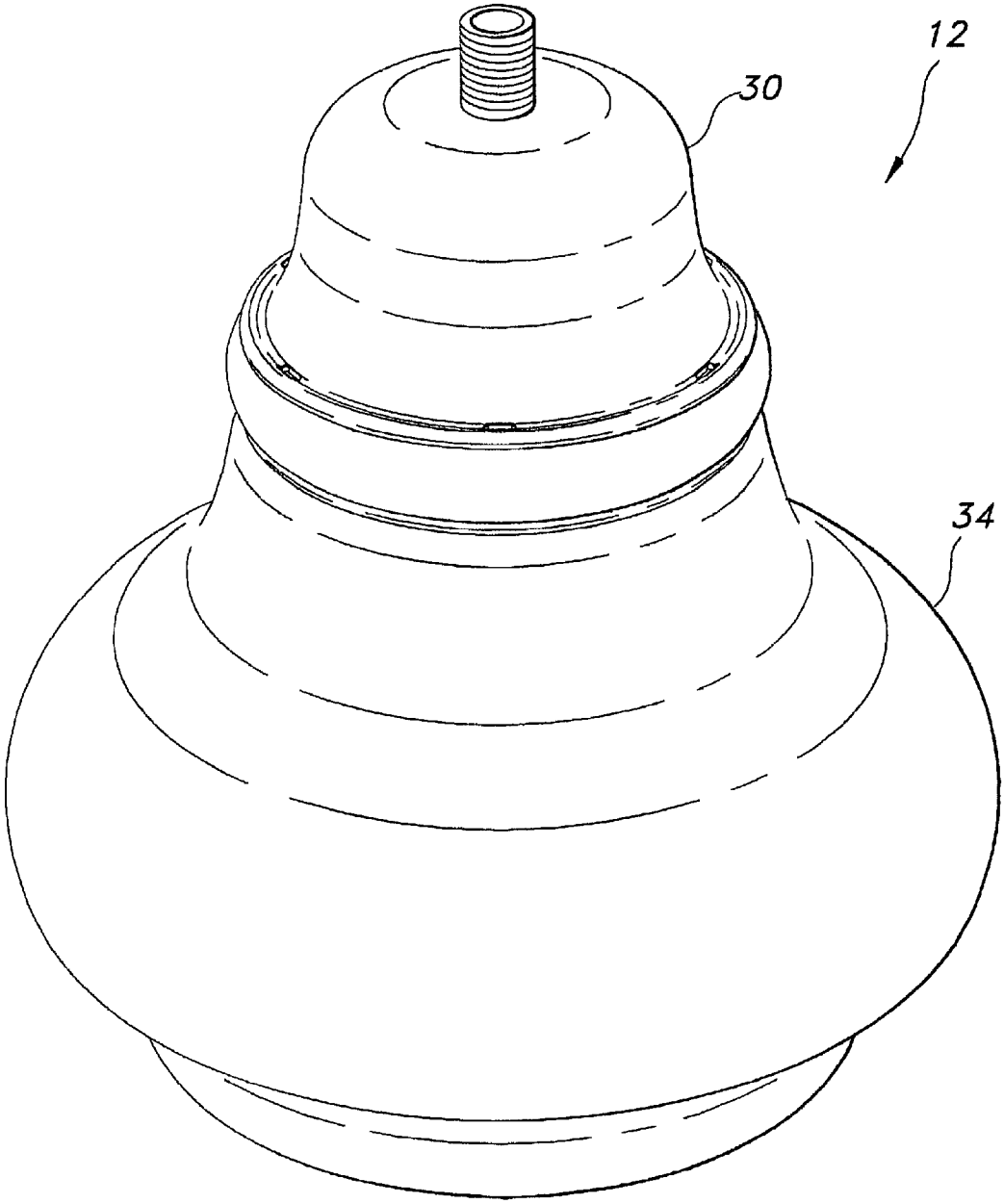
FIG. 2 is a perspective view illustrating a light fixture according to the present invention, which is illustrated with the ceiling fan in FIG. 1.
Figure 3:
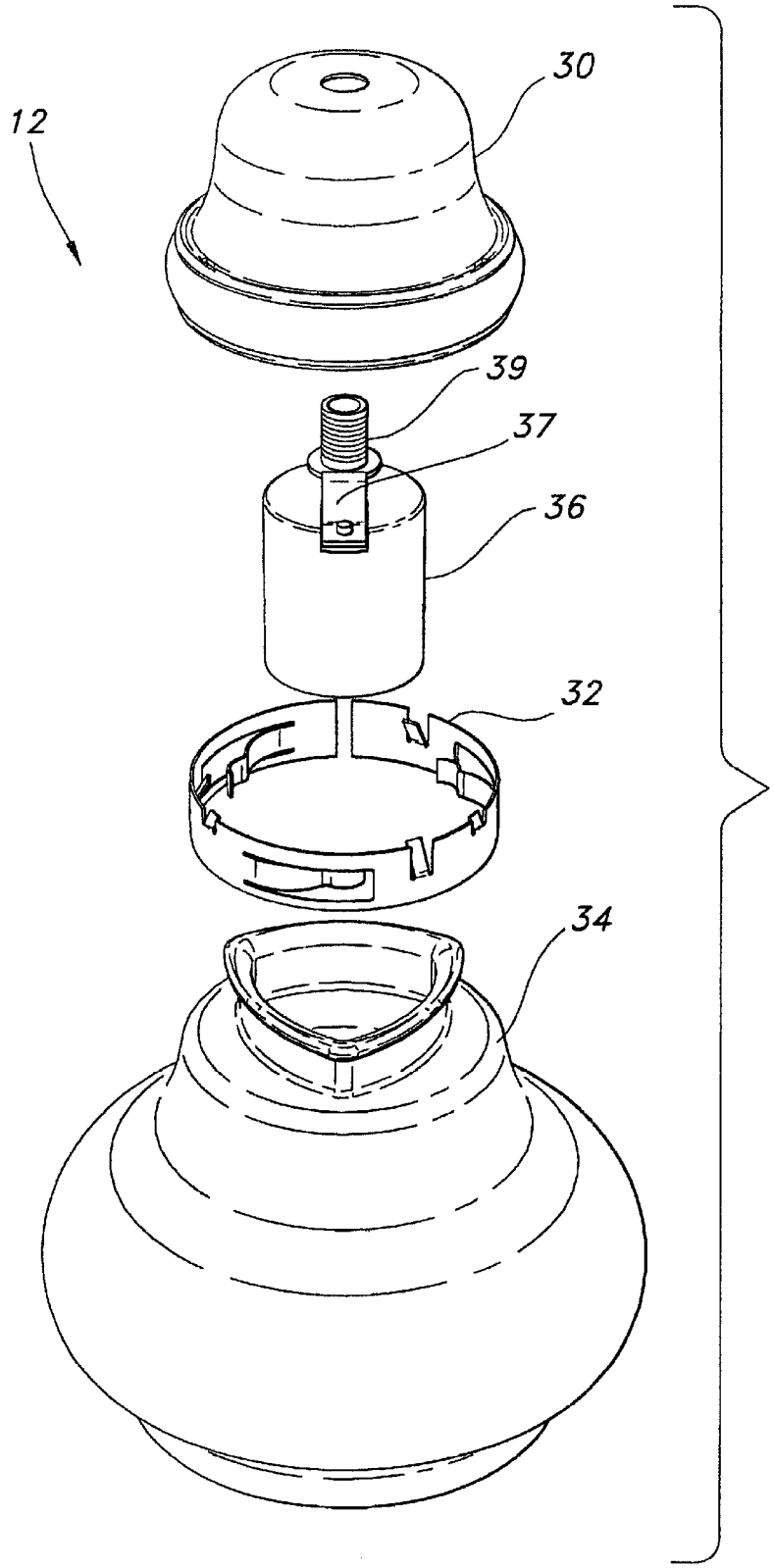
FIG. 3 is an exploded assembly, perspective view further illustrating the light fixture according to the present invention which is illustrated in FIGS. 1 and 2.
Figure 4:
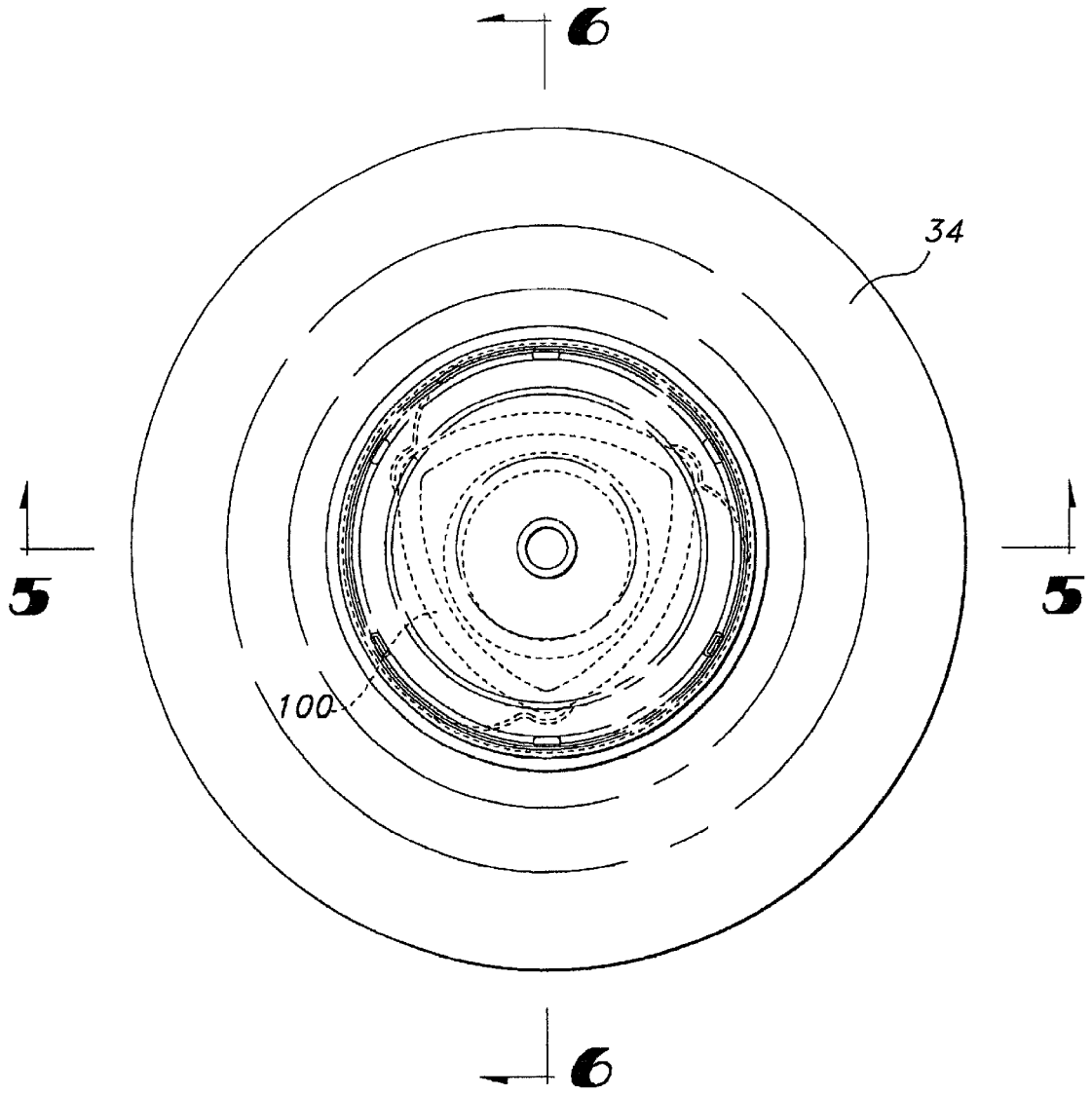
FIG. 4 is a top plan view of the light fixture shown in FIGS. 1–3, with selected features of the included light shade being shown in broken lines to illustrate the orientation of the cross-sectional views shown in FIGS. 5 and 6 relative to the light shade.

FIG. 2 is a perspective assembly view, illustrating one of the light fixtures 12 according to the present invention, and FIG. 3 is an exploded assembly, perspective view further illustrating the light fixture 12 shown in FIG. 1. As shown in FIGS. 2 and 3, each of the light fixtures 12 includes an annular fitter 30, a substantially annular retention member 32 and a light shade 34. Light fixture 12 may further include a conventional light socket 36 which is disposed within the annular fitter 30. The particular features of light socket 36 are well known in the art. The light socket 36 may be secured to a mount bracket 37, which in turn is secured to a threaded nipple 39 which extends through a subsequently discussed aperture 48 in fitter 30. The threaded nipple 39 may be secured to one of the hollow support arms 28 of ceiling fan 10, thereby providing support for the light fixture 12.

Figure 9:
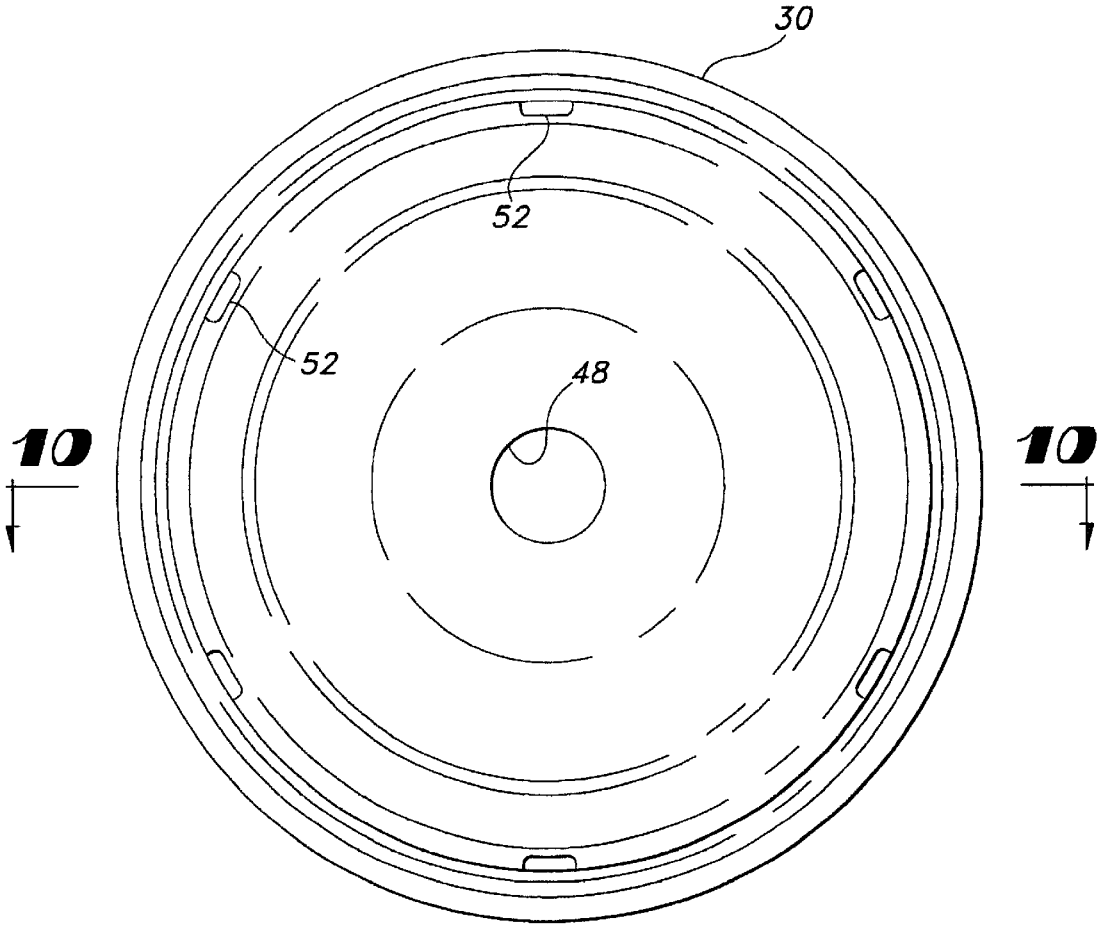
FIG. 9 is a bottom plan view of the fitter included in the light fixture according to the present invention.
Figure 10:
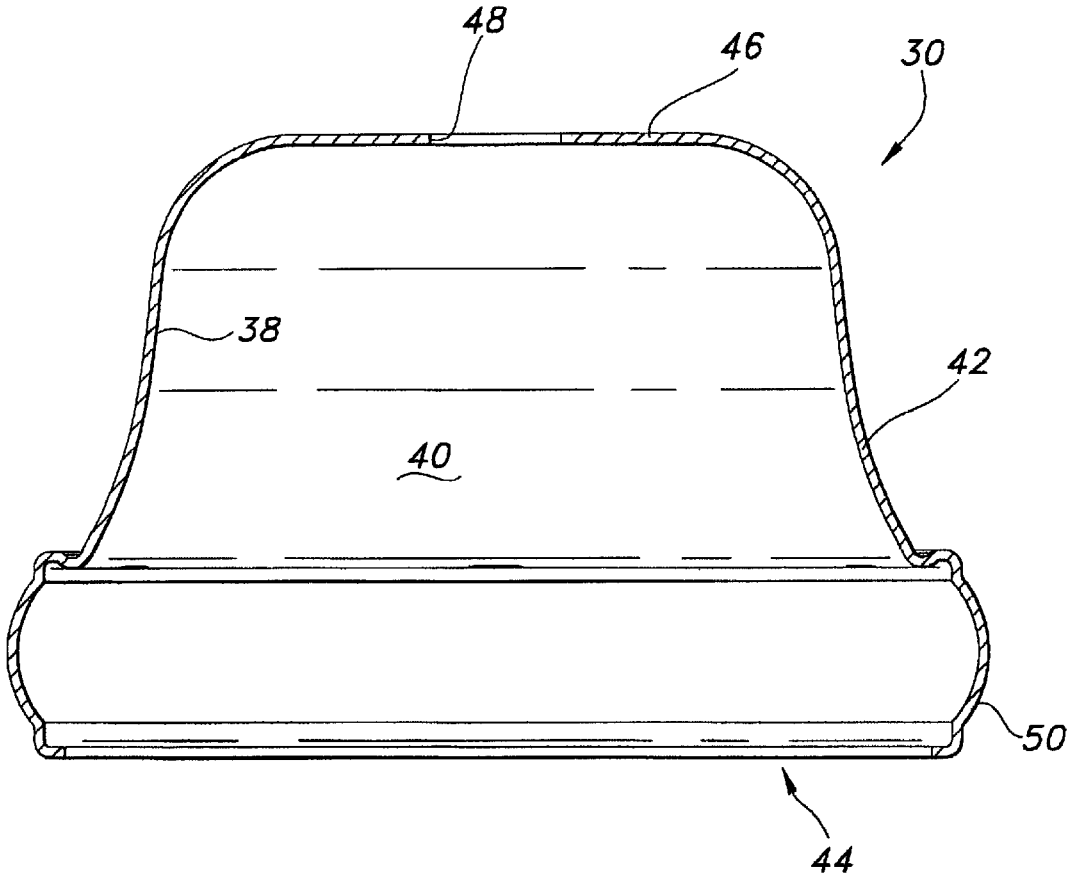
FIG. 10 is a cross-sectional view taken along line 10—10 in FIG. 9.

The annular fitter 30, light socket 36, retention member 32 and light shade 34 are assembled to one another and interact with one another, as subsequently discussed in greater detail with regard to FIGS. 3–8. Referring now to FIGS. 9 and 10, the particular features of the illustrative embodiment of the annular fitter 30 will now be discussed in greater detail. Fitter 30 includes an inner surface 38 defining a hollow interior 40 of the annular fitter 30, and further includes an outer surface 42. In the illustrative embodiment, the outer surface 42 is generally bell-shaped. However, the annular fitter 30 may assume a wide variety of other shapes within the scope of the present invention. Additionally, the annular fitter 30 includes a first open end 44 which, as subsequently discussed in greater detail, is effective for receiving a portion of the lamp shade 34. The annular fitter 30 also includes a substantially closed end 46 and an aperture 48 extending through the closed end 46. In the illustrative embodiment, the aperture 48 may comprise a substantially round hole. However, aperture 48 may assume other shapes. Aperture 48 is effective for receiving a fastener such as nipple 39 or other mounting device therethrough, for the purpose of providing support to the light fixture 12, as previously discussed. The annular fitter 30 further includes an annular ring portion 50 which is disposed proximate the open end 44, with the annular ring portion 50 being effective for receiving the retention member 32 within the hollow interior 40 of fitter 30.

As best seen in FIG. 9, the annular fitter 30 also includes a plurality of circumferentially spaced apertures 52 which engage with mating parts on the retention member 32, as subsequently discussed, to prevent the retention member 32 from rotating relative to fitter 30. However, as subsequently discussed, it is considered within the scope of the present invention to provide other means to prevent the rotation of retention member 32 relative to fitter 30, including, but not limited to, the welding of retention member 32 to the annular fitter 30.

Figure 11:
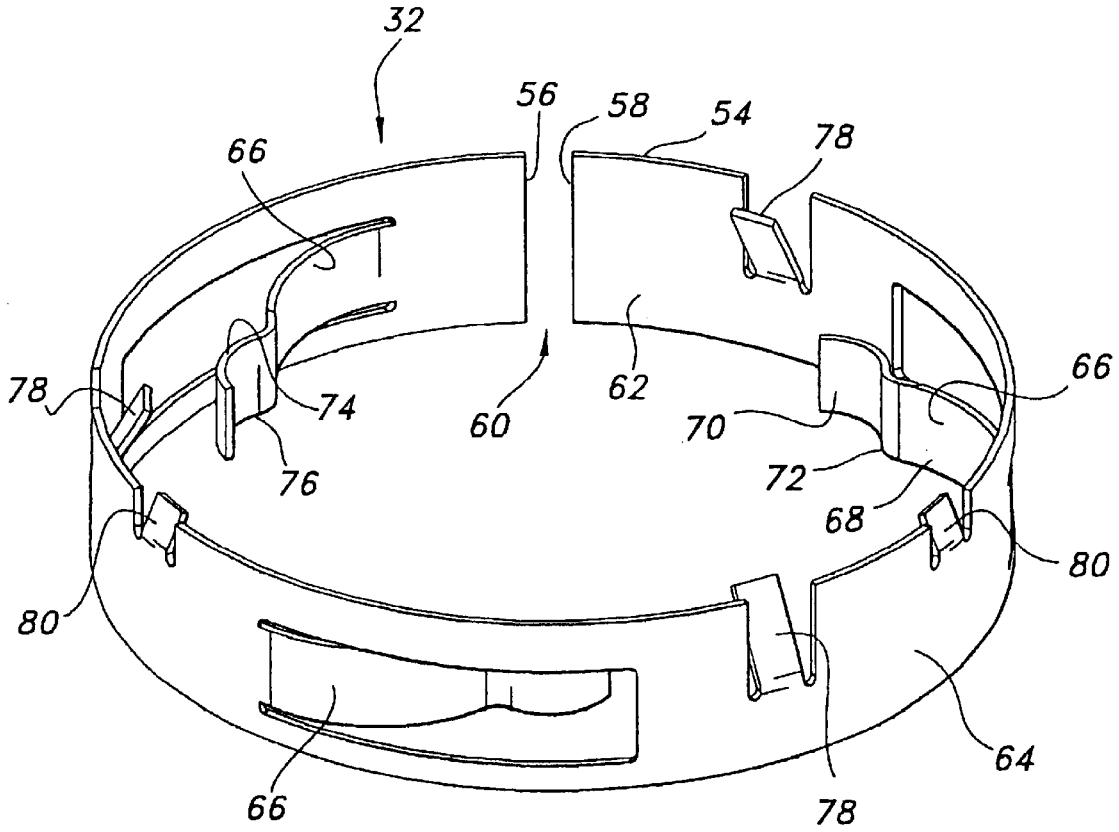
FIG. 11 is a perspective view illustrating a retention member included in the light fixture according to the present invention.
Figure 12:
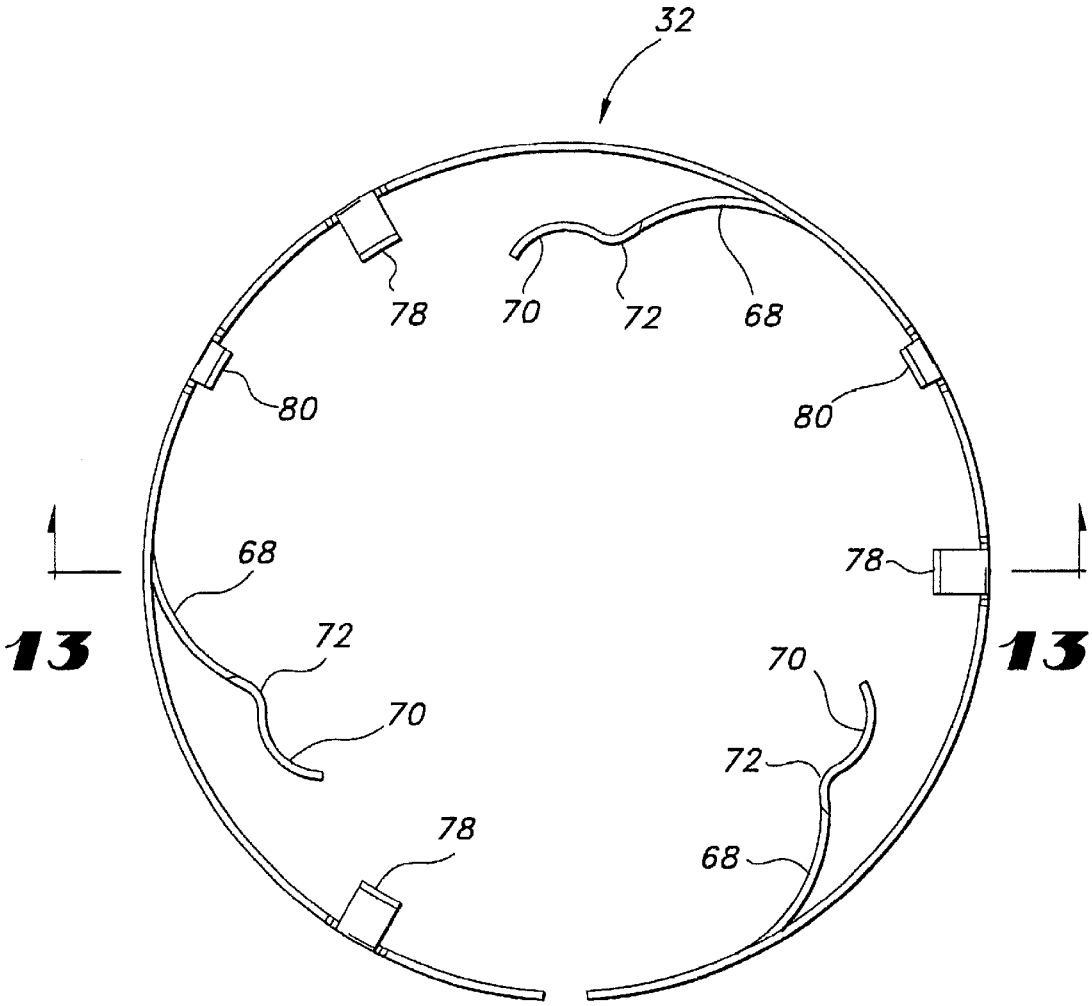
FIG. 12 is a plan view of the retention member shown in FIG. 11.
Figure 13:
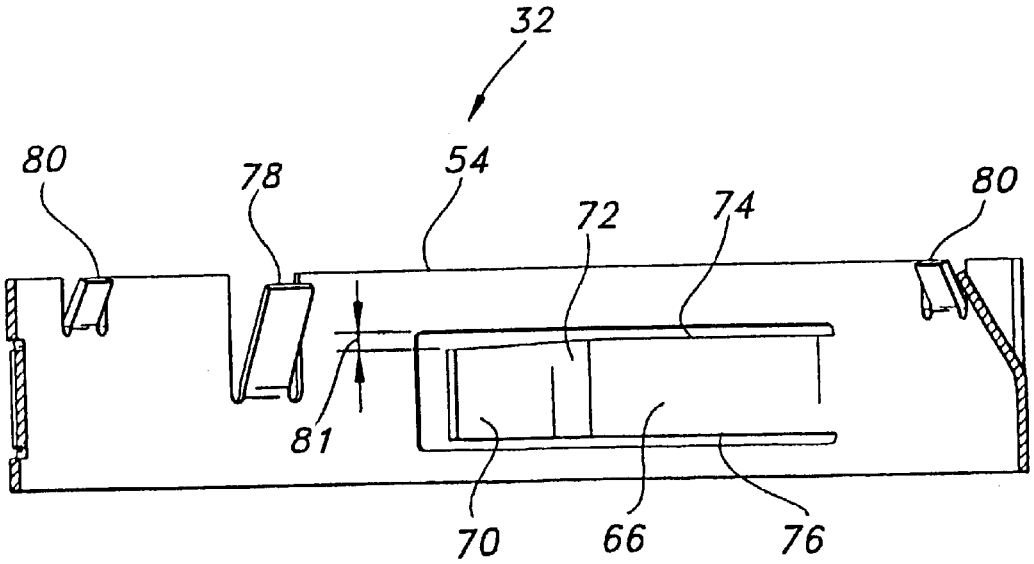
FIG. 13 is a cross-sectional view taken along line 13—13 in FIG. 12.

Referring now to FIGS. 11–13, the particular features of the substantially annular retention member 32, will now be discussed in further detail. Retention member 32 is considered to be substantially annular, rather than fully annular, since retention member 32 includes a substantially annular base portion 54 having first 56 and second 58 circumferentially facing ends which are separated by a gap 60. The presence of gap 60 facilitates the positioning of the retention member 32 within the hollow interior 40 of the annular fitter 30 due to the resulting flexibility of retention member 32 during installation, as a result of gap 60. The annular base portion 54 includes a radially inner surface 62 and a radially outer surface 64, with at least a portion of the radially outer surface 64 being disposed in contacting engagement with the inner surface 38 of the annular fitter 30.

Retention member 32 further includes a plurality of circumferentially spaced springs 66 integral with the base 54 of retention member 32 and protruding radially inwardly from the base portion 54.

Each of the springs 66 includes a substantially arcuate proximal portion 68 which is integral with the base 54 of retention member 32 and protrudes radially inwardly from base 54. Each of the springs 66 further include a substantially arcuate distal portion 70 and an intermediate portion 72 interconnecting the substantially arcuate proximal 68 and distal 70 portions. Furthermore, each of the spring longitudinally facing edges 74 and 76. Springs 66 interact with light shade 34 as subsequently discussed.

As best seen in FIG. 13, the distal portion 70 and intermediate portion 72 of each of the springs 66 are tapered longitudinally relative to the proximal portion 68 of the corresponding spring 66. More particularly, the portion of the longitudinally facing edge 74 existing throughout intermediate portion 72 and distal portion 70 is tapered relative to the portion of edge 74 extending throughout the proximal portion 68, and defines a taper angle 81, shown in FIG. 13. The magnitude of taper angle 81 preferably ranges from about 1 degree to about 15 degrees, and more preferably is about 3 degrees.

The substantially annular retention member 32 also includes a plurality of circumferentially spaced circumferential stops 78 which are integral with base portion 54 and protrude radially inwardly therefrom. The particular function of the circumferential stops 78 will be discussed subsequently in greater detail. The substantially annular retention member 32 firther includes a plurality of circumferentially spaced anti-rotation tabs 80, with each of the anti-rotation tabs 80 engaging with one of the apertures 52 of the annular fitter 30, in the illustrative embodiment, so as to prevent the retention member 32 from rotating relative to the fitter 30. However, as discussed previously, the retention member 32 may alternatively be welded to the fitter 30, so as to prevent relative rotation. Additionally, anti-rotation devices other than tabs 80 and apertures 52 may be provided, within the scope of the present invention.

In one preferred embodiment, the base portion 54, springs 66, circumferential stops 78 and anti-rotation tabs 80 of the substantially annular retention member 32 are made as a one piece construction. However, in other embodiments one or more of the foregoing elements made be made separately and attached to one another. As shown in FIGS. 11 and 12, each of the circumferential stops 78 are disposed circumferentially between an adjacent pair of the springs 66. Furthermore, in the illustrative embodiment, the retention member 32 includes three of the springs 66, which are substantially equally spaced circumferentially from one another and three of the circumferential stops 78 which are substantially equally spaced circumferentially from one another.

Referring now to FIGS. 14–17, the particular features of the light shade 34 are discussed in further detail. The light shade 34 includes a neck 82 and a light-emitting enclosure 84 integral with the neck 82. The light-emitting enclosure 84 has an inner surface 86 defining a hollow interior 88 of the enclosure 84, and an outer surface 90. The light-emitting enclosure 84 further includes an open end 92, which is effective for inserting a light source (not shown) such as an incandescent bulb within the hollow interior 88 of enclosure 84, such that enclosure 84 is disposed in surrounding relationship with at least a portion of the light source. The light-emitting enclosure 84 is integral with the neck 82 of light shade 34, and the light-emitting enclosure 84 may assume a wide variety of shapes, with the particular shape of the light-emitting enclosure 84 not forming a part of the present invention.

Figure 17:
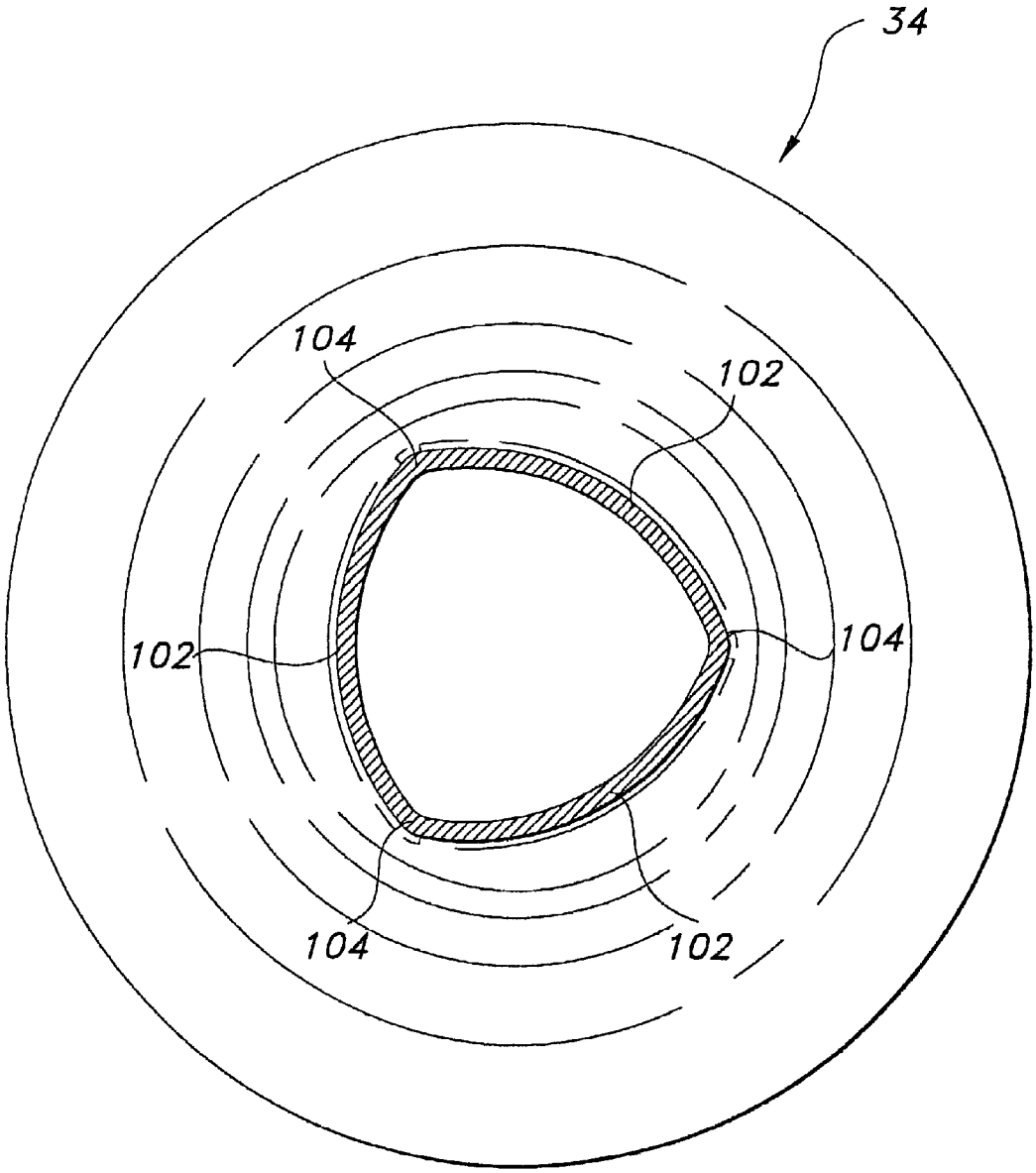
FIG. 17 is a cross-sectional view taken along line 17—17 in FIG. 16.

The neck 82 of light shade 34 includes a first lobed portion 94 having a proximal end 96 integral with the light-emitting enclosure 84 and a distal end 98. The neck 82 further includes a lobed flange 100 which is integral with the distal end 98 of the first lobed portion 94 of neck 82. As best seen in FIG. 17, the lobed portion 94 of neck 82 includes a plurality of radially outwardly extending lobes 102, with each of the lobes 102 having an apex portion 104. In the illustrative embodiment, the lobed portion 94 of neck 82 includes three of the lobes 102. However, in other embodiments, the lobed portion 94 may include other numbers of lobes 102, provided a like number of springs 66 and stops 78 are included in retention member 32.

Figure 14:
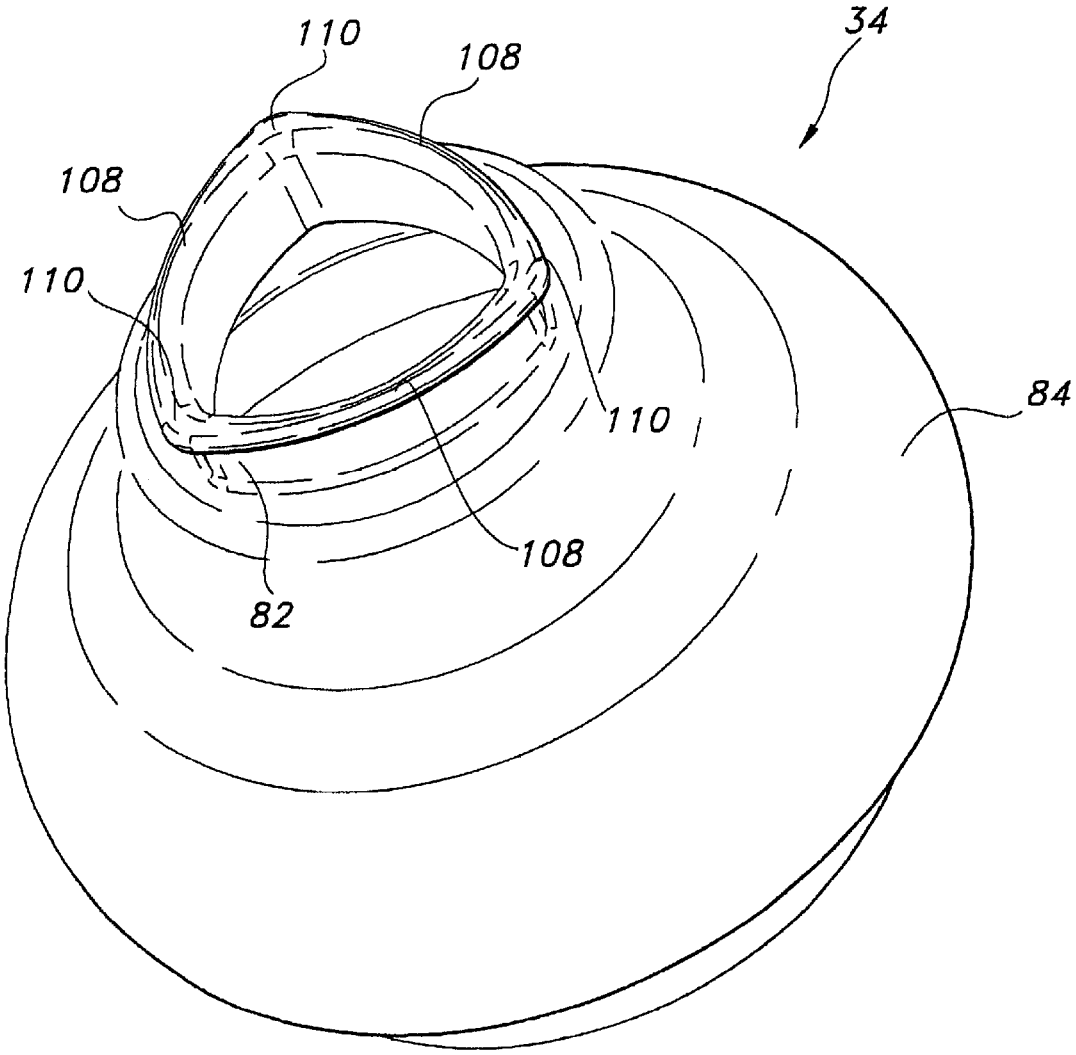
FIG. 14 is a perspective view illustrating a light shade included in the light fixture according to the present invention.
Figure 15:
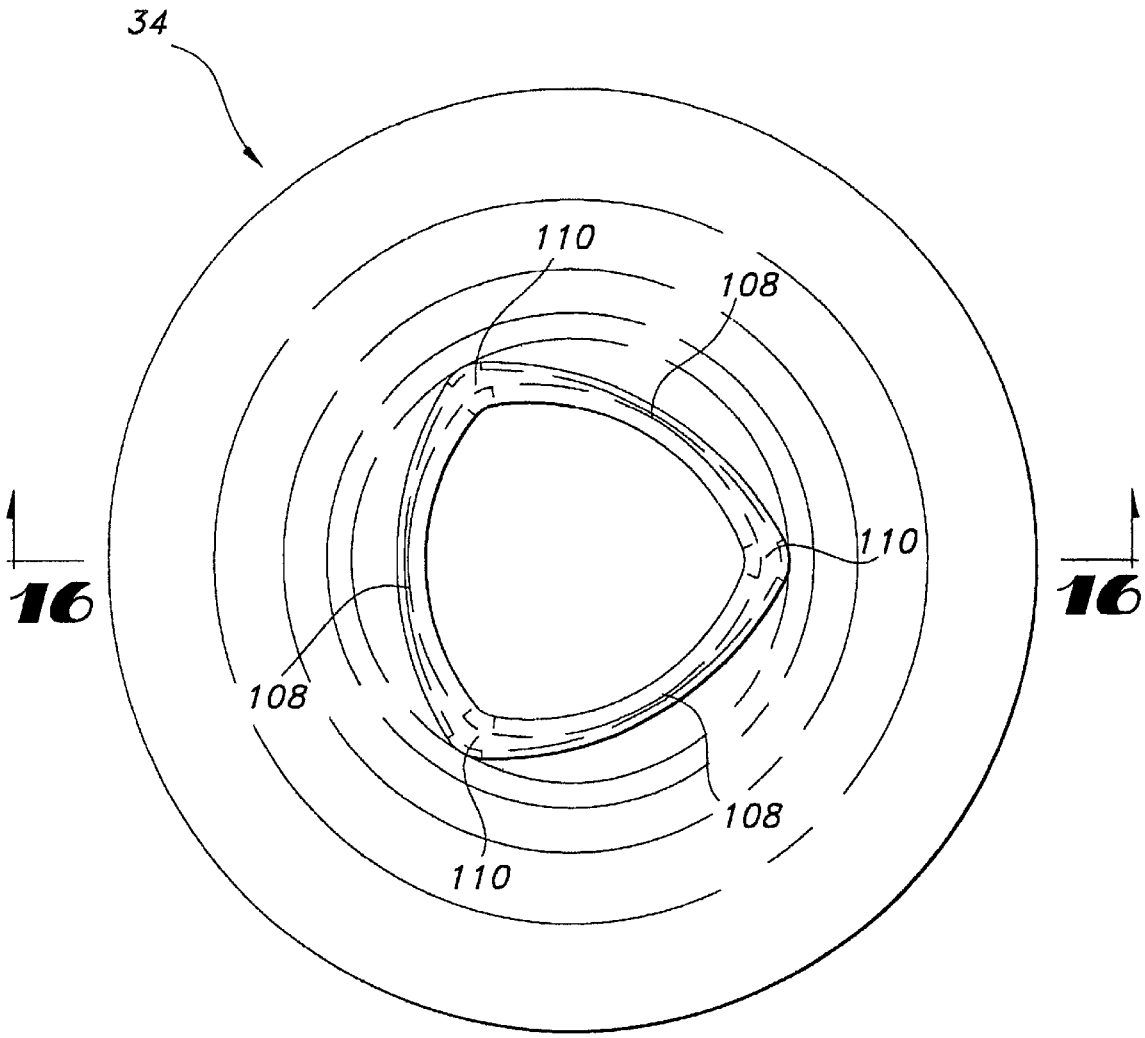
FIG. 15 is a top plan view further illustrating the light shade shown in FIG. 14.
Figure 16:
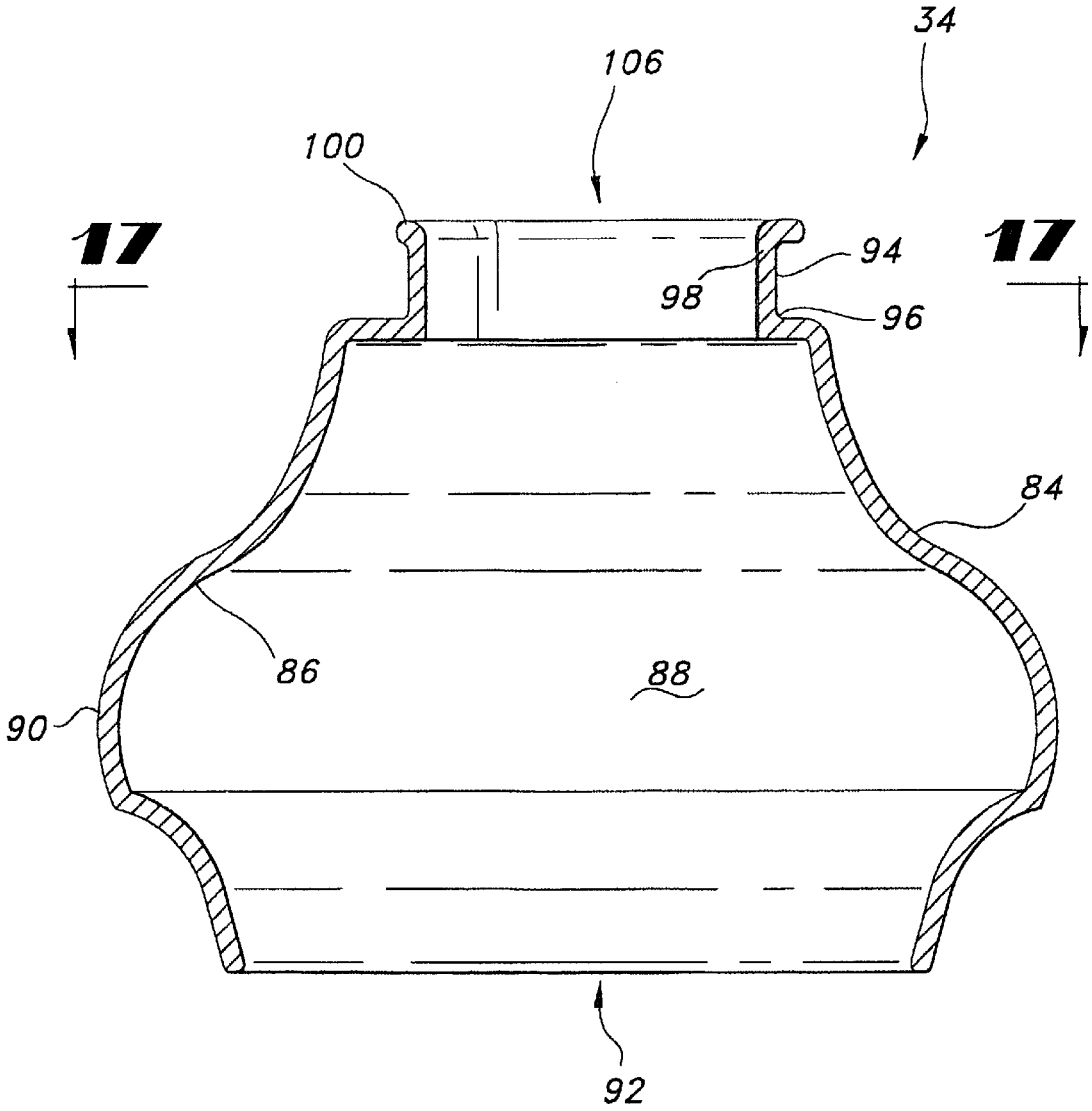
FIG. 16 is a cross-sectional view taken along line 16—16 in FIG. 15.

The lobed flange 100 and the first lobed portion 94 of neck 82 combine to define a substantially centrally disposed aperture 106 extending through neck 82, with the aperture 106 communicating with the hollow interior 88 of the light-emitting enclosure 84 and being effective for receiving a portion of the light source disposed within light shade 34, therethrough. As best seen in FIGS. 14 and 15, the lobed flange 100 includes a plurality of radially outwardly extending lobes 108, with each of the lobes 108 having an apex portion 110 disposed radially outwardly of the first lobed portion 94 of neck 82. Neck 82 of light shade interacts with the substantially annular retention member 32 as subsequently discussed.

Figure 5:
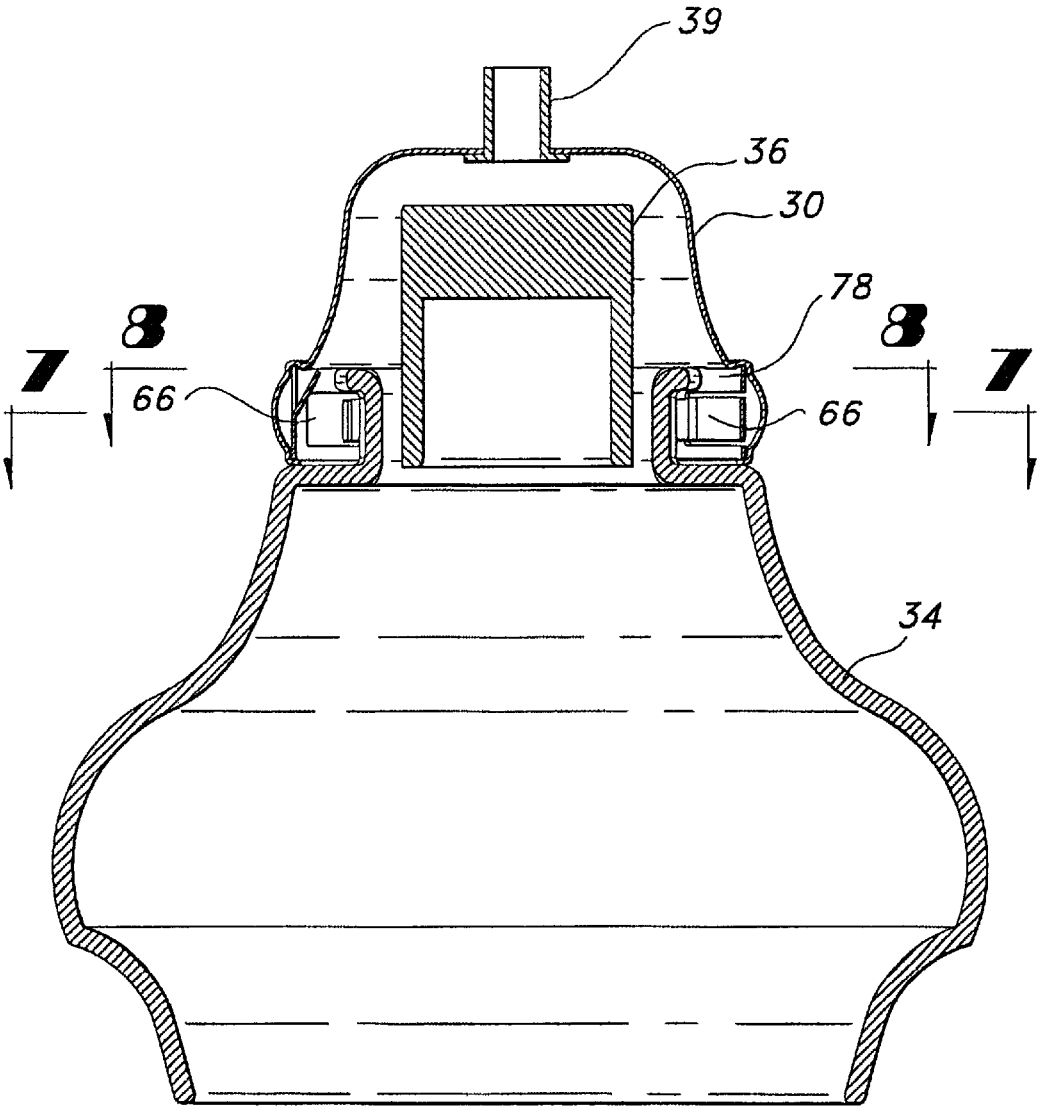
FIG. 5 is a cross-sectional view taken along line 5—5 in FIG. 4.
Figure 6:
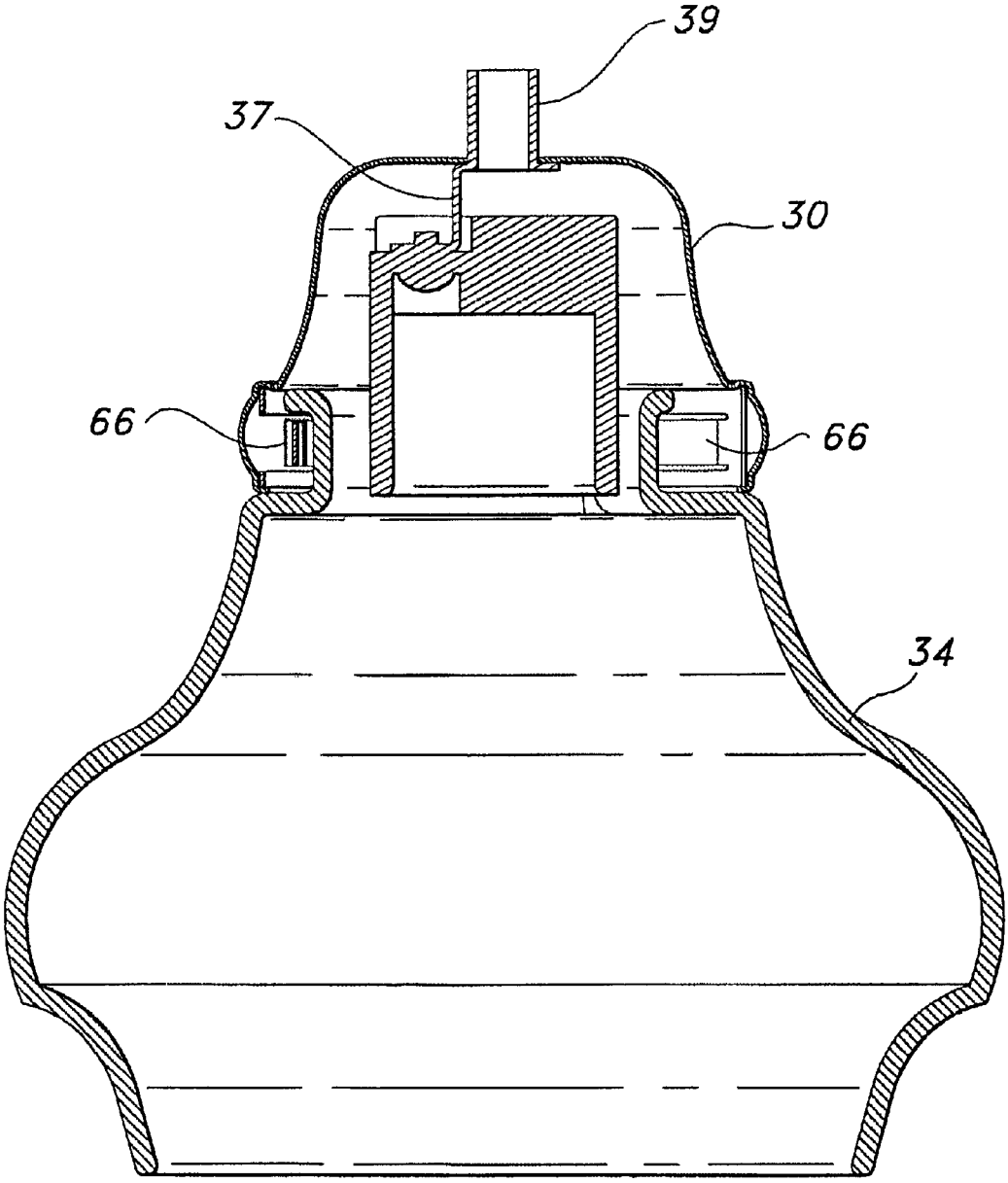
FIG. 6 is a cross-sectional view taken along line 6—6 in FIG. 4.
Figure 7:
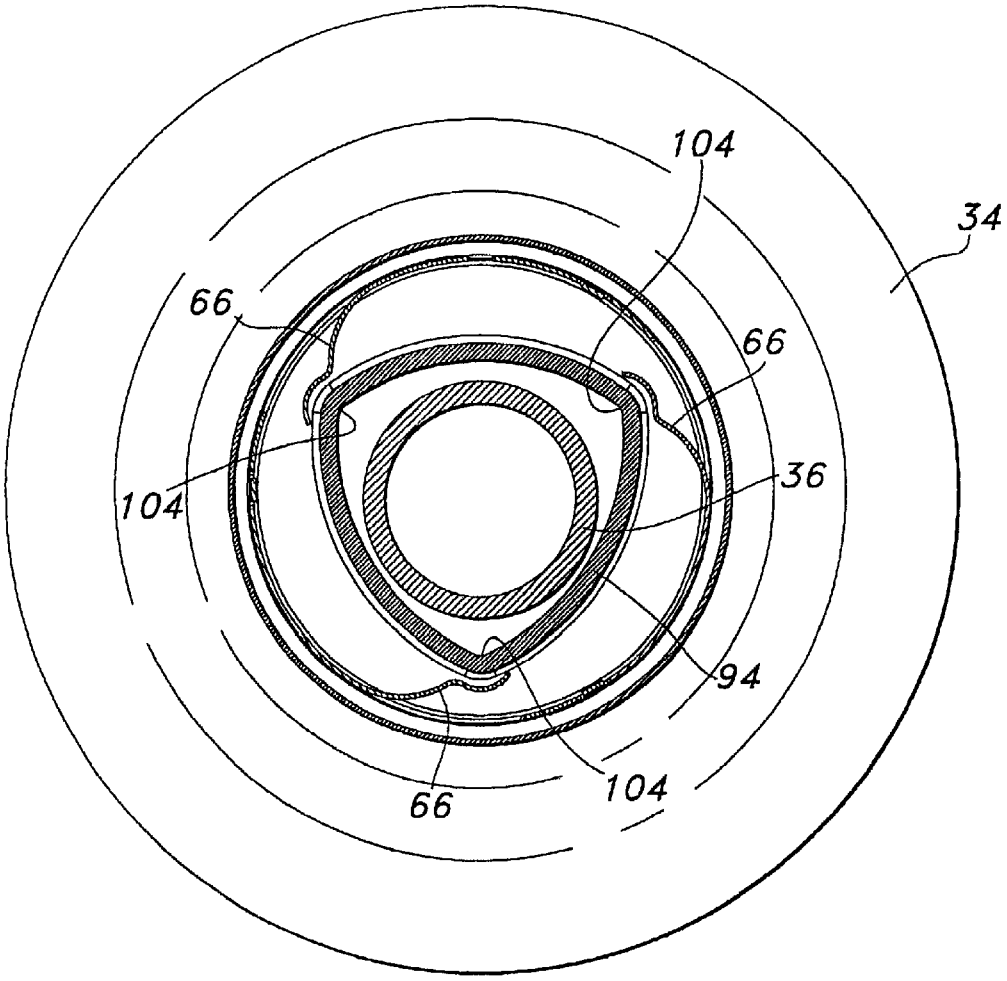
FIG. 7 is a cross-sectional view taken along line 7—7 in FIG. 5, illustrating the light shade in a locked position.
Figure 7A:
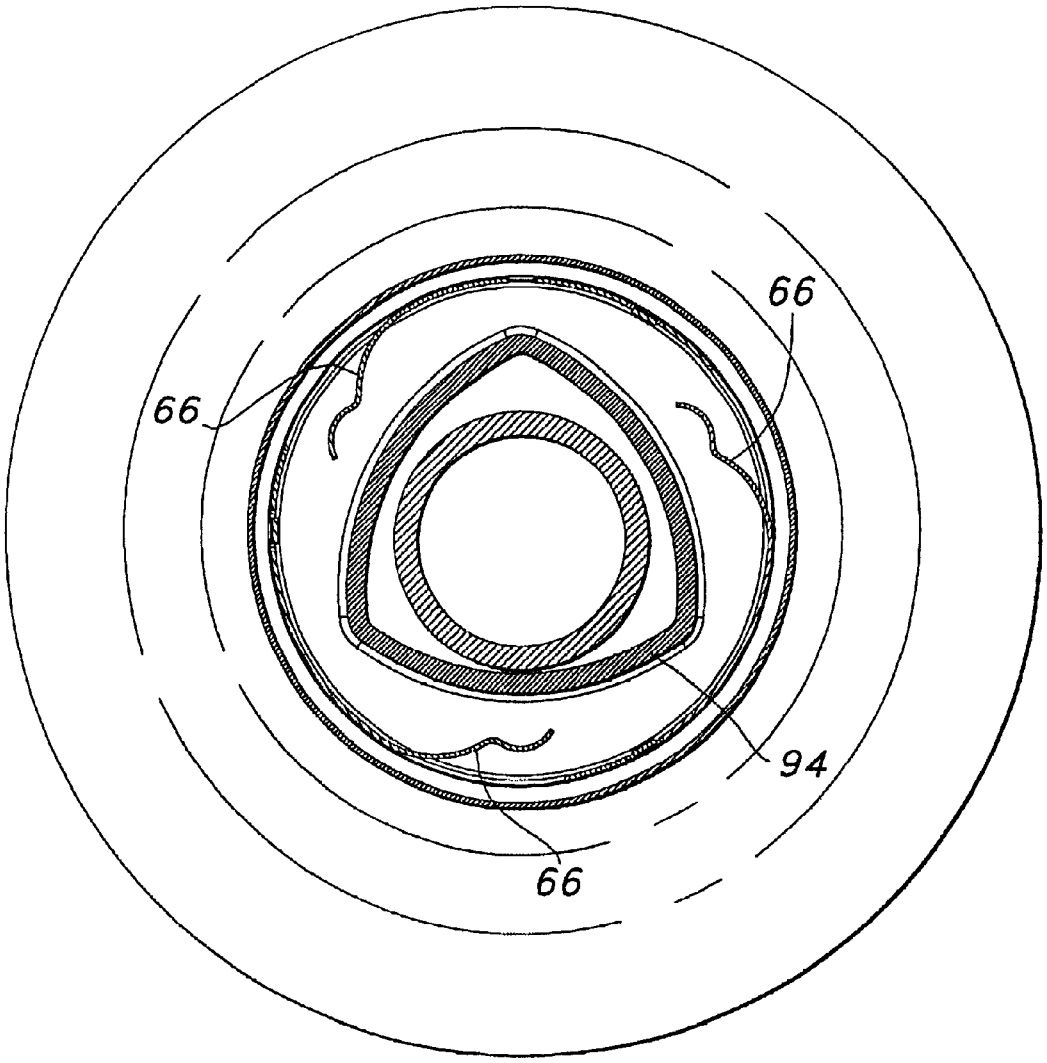
FIG. 7A is a view similar to FIG. 7, but with the light shade illustrated in an unlocked position.
Figure 8:
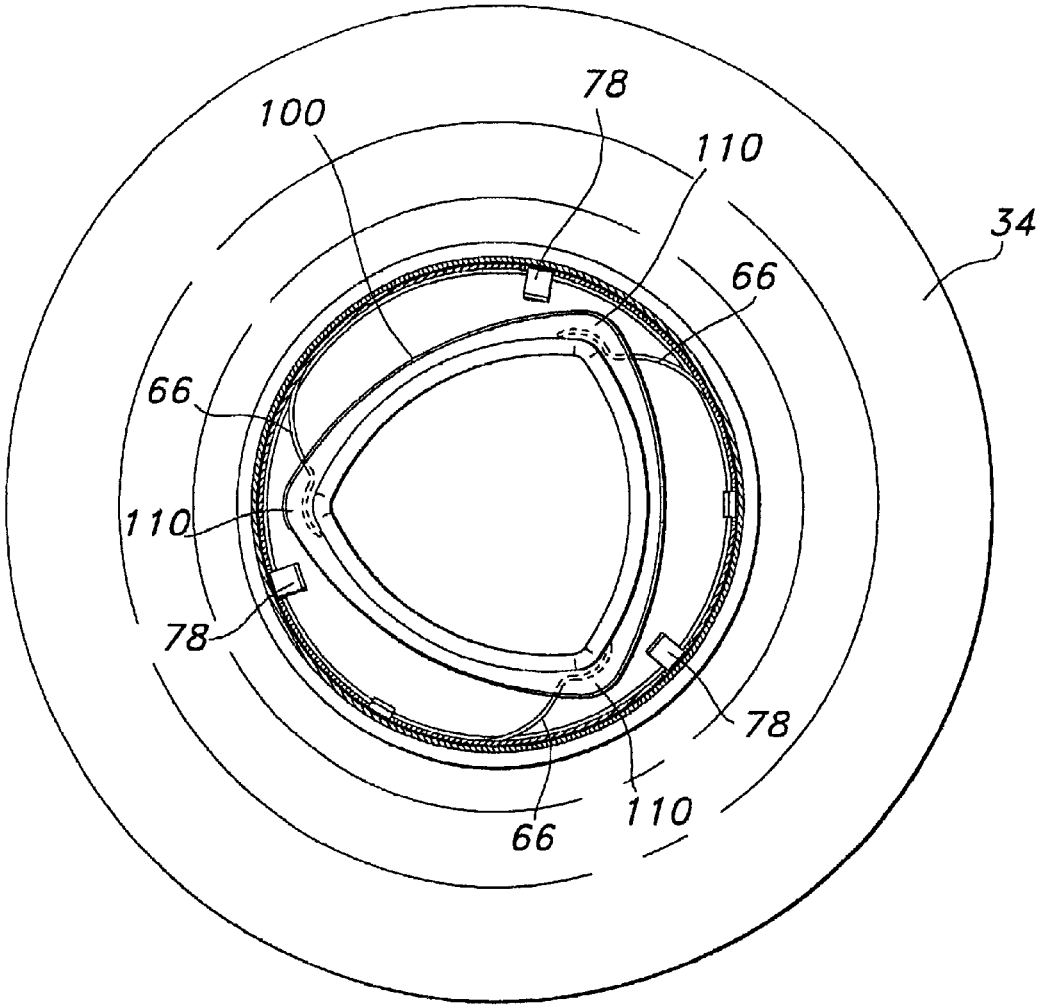
FIG. 8 is a cross-sectional view taken along line 8—8 in FIG. 5, illustrating the light shade in a locked position.
Figure 8A:
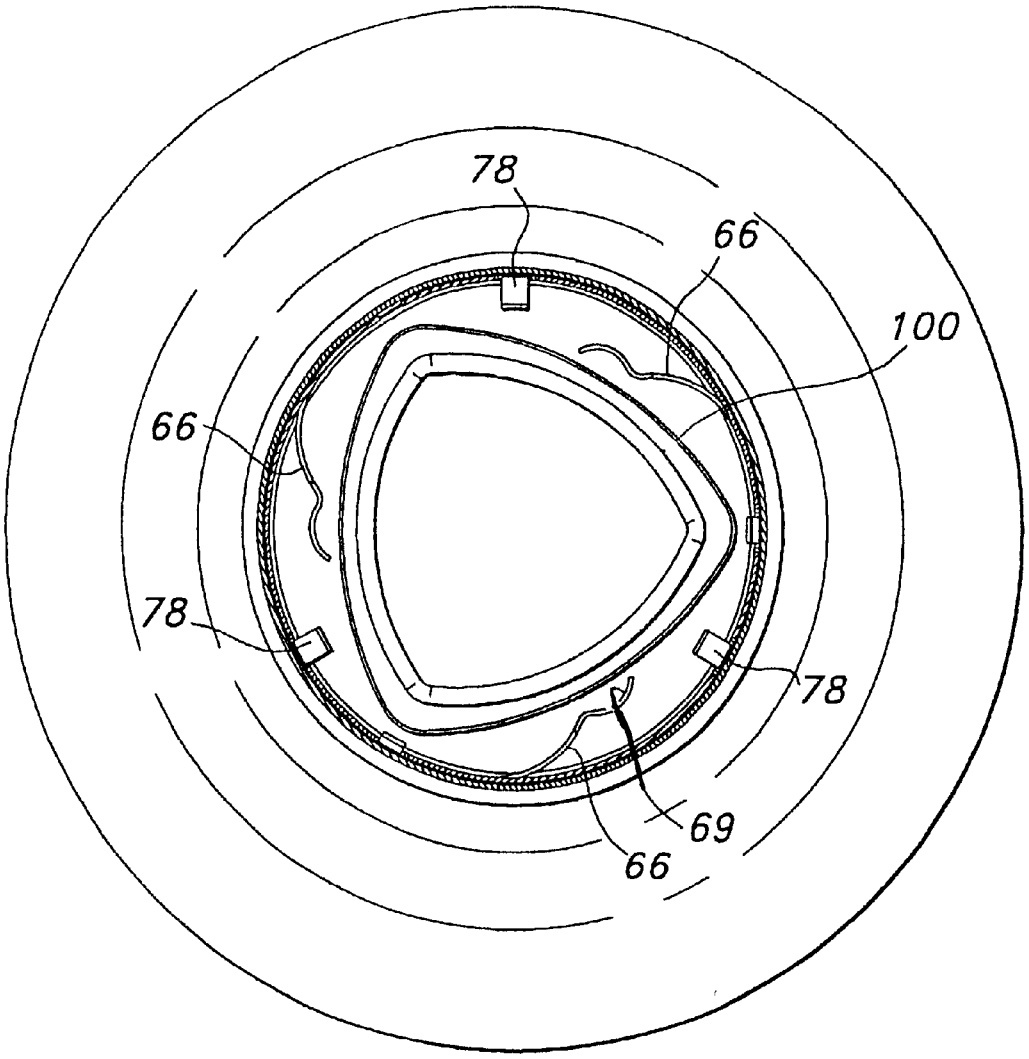
FIG. 8A is a view similar to FIG. 8, but with the light shade illustrated in an unlocked position.

The relationship among the annular fitter 30, the substantially annular retention member 32 and the light shade 34, as well as the manner in which the retention member 32 and light shade 34 interact with one another during installation, may be appreciated with particular reference to FIGS. 5, 6, 7, 7A, 8 and 8A. FIGS. 5 and 6 are both cross-sectional views, taken from different locations, illustrating the fitter 30, retention member 32 and light shade 34 in an installed, locked position. Additionally, FIGS. 7 and 8 are cross-sectional views illustrating the light shade 34 in an installed, locked position, while FIGS. 7A and 8A are similar views but with the light shade 34 in an initial, unlocked position.

As shown in FIG. 7, when the light shade 34 is in an installed position, each of the springs 66 of the retention member 32 is disposed in contacting engagement with the first lobed portion 94 of the neck 82 of shade 34. More particularly, the distal portion 70 of each of the springs 66 is disposed in contacting engagement with the apex portion 104 of one of the lobes 102 of the first lobed portion 94 of neck 82. When the shade 34 is in an initial, unlocked position, the springs 66 are spaced apart from the first lobed portion 94 of neck 82. Furthermore, as shown in FIG. 8, the distal end portion 70 of each of the springs 66 is disposed underneath the apex portion 110 of one of the lobes 108 of the lobed flange 100, when light shade 34 is in a locked position. Also, when the light shade is in a locked position, each of the circumferential stops 78 is disposed proximate one of the apex portions 110 of the lobed flange 100, with the circumferential stops 78 being horizontally aligned with the lobed flange 100. In the unlocked position, the circumferential stops 78 are spaced farther away from the apex portions 110 of the lobes 108 of lobed flange 100, as shown in FIG. 8A.

When a user wishes to install light shade 34, the user may simply insert the neck 82 of shade 34 into the hollow interior 40 of the annular fitter 30, by orienting neck 82 so that it is not in contacting engagement with the springs 66 of the retention member 32. Furthermore, in the initial, unlocked position, the flange 100 of neck 82 should be disposed above springs 66, which may be accomplished simply by positioning shade 34 in abutting relationship, or in close proximity, with the annular fitter 30. The user may then simply rotate light shade 34 in a counterclockwise direction as seen in FIGS. 7, 7A, 8 and 8A (it should be understood that the direction of rotation will be opposite as viewed below by the user installing light shade 34). During the counterclockwise rotation of light shade 34, the proximal portion 68 of each of the springs 66 comes into contact with neck 82 in two ways. In the first instance, a radially inwardly facing surface 69 of the proximal portion 68 of each spring 66 comes into contact with the first lobed portion 94 of neck 82. Secondly, the longitudinally facing edge 74, in the area of the proximal portion 68, comes into contact with the underneath surface of flange 100. As the flange 100 rotates into the final installed position, the distal portion 70 of each of the springs 66 is disposed in contacting engagement with the apex portion 104 of the lobed portion 94 of neck 82, which relieves the spring tension exerted on neck 82 due to the configuration of the distal portion 70 of each spring 66 relative to the remainder of spring 66. The spring tension is further relieved, due to the taper angle 81 existing throughout the distal portion 70 and intermediate portion 72 of each spring 66. The foregoing combination of spring tension reliefs provides an identifiable "feel" to the user when light shade 34 is rotated into a locked position.

As may be appreciated from FIG. 8, the close proximity of the circumferential stops 78 to the flange 100 of neck 82, prevents the user from substantially over-rotating the light shade 34 past a locked position. If the user were to do so, the flange 100 would come into contacting engagement with the circumferential stops 78. Furthermore, as may be appreciated from FIG. 8A, which illustrates the unlocked position, the circumferential stops 78 prevent the user from rotating in an incorrect direction between the initial installed and final locked position. More particularly, if the user were to attempt to rotate clockwise, as viewed in FIG. 8A, the flange 100 of neck 82 would come into contact with one or more of the stops 78, with the shade 34 remaining in an unlocked position. This is easy to recognize for the user, since the shade would remain loose in this unlocked position.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, while the light fixture 12 has been illustrated for use in conjunction with ceiling fan 10, it should be clearly understood that light fixture 12 is not limited to applications with ceiling fans. More particularly, light fixture 12 may be directly mounted to a ceiling, may be part of a wall sconce, or may comprise a portion of a desk or table lamp. The invention is therefore not limited to specific preferred embodiments as described, but is only limited as defined by the following claims.

What is claimed is:

1. A light fixture comprising:

an annular fitter having inner and outer surfaces, said inner surface defining a hollow interior of said annular fitter, said annular fitter further including an open first end;

a substantially annular retention member disposed within said annular fitter, said substantially annular retention member including a substantially annular base portion having a radially inner surface and a radially outer surface, wherein at least a portion of said radially outer surface is disposed in contacting engagement with said inner surface of said annular fitter, said retention member further including a plurality of circumferentially spaced springs integral with said base portion and protruding therefrom, said retention member further including a plurality of circumferential spaced circumferential stops integral with said base portion and protruding therefrom;

a light shade having a neck and a light-emitting enclosure integral with said neck, said neck including a first lobed portion having a proximal end integral with said light-emitting enclosure and a distal end, said neck further including a lobed flange integral with said distal end of said first lobed portion of said neck; wherein said neck of said light shade and said retention member cooperate with one another to permit a user to insert said neck of said light shade through said open end of said fitter into said hollow interior of said fitter and then to rotate said light shade from an unlocked position into a locked position to connect said shade to said retention member.

2. The light fixture as recited in claim 1, wherein:

each of said springs is disposed in contacting engagement with first lobed portion of said neck when said light shade is in said locked position;

each of said springs is radially spaced from said first lobed portion of said neck when said light shade is in said unlocked position.

3. The light fixture as recited in claim 2, wherein:

said first lobed portion of said neck includes a plurality of radially outwardly extending lobes, each of said lobes including an apex portion;

each of said springs is disposed in contacting engagement with said apex portion of one of said lobes when said light shade is disposed in said locked position.

4. The light fixture as recited in claim 3, wherein each of said springs includes:

a substantially arcuate proximal portion, a substantially arcuate distal portion and an intermediate portion interconnecting said substantially arcuate proximal and distal portions, said substantially arcuate proximal portion being integral with said base portion of said retention member;

wherein said substantially arcuate distal portion of each of said springs is disposed in contacting engagement with said apex portion of one of said lobes of said first lobed portion of said neck when said light shade is disposed in said locked position.

5. The light fixture as recited in claim 4, wherein:

said distal portion and said intermediate portion of each of said springs are tapered longitudinally relative to said proximal portion of said spring.

6. The light fixture as recited in claim 2, wherein:

said lobed flange of said neck includes a plurality of radially outwardly extending lobes, each of said lobes having an apex portion disposed radially outwardly of said first lobed portion of said neck;

said circumferential stops are horizontally aligned with said lobed flange and each of said circumferential stops is disposed proximate said apex portion of one of said lobes of said lobed flange when said light shade is in said locked position.

7. The light fixture as recited in claim 6, wherein:

said retention member includes three of said circumferential stops which are substantially equally spaced from one another;

said lobed flange includes three of said radially outwardly extending lobes which are substantially equally spaced from one another.

8. The light fixture as recited in claim 1, wherein:

said fitter includes an annular ring portion disposed proximate said open end of said fitter;

said retention member is disposed within said annular ring portion of said fitter.

9. The light fixture as recited in claim 1, wherein:

each of said circumferential stops is disposed circumferentially between an adjacent pair of said springs of said retention member.

10. The light fixture as recited in claim 1, wherein:

said annular base portion, said springs and said circumferential stops of said substantially annular retention member are made as a one-piece construction.

11. The light fixture as recited in claim 1, wherein:

said annular fitter includes a plurality of circumferentially spaced apertures formed therein;

said substantially annular retention member includes a plurality of circumferentially spaced anti-rotation tabs protruding from said substantially annular base portion of said substantially annular retention member, each of said anti-rotation tabs of said retention member being engaged with one of said circumferentially spaced apertures of said annular fitter.

12. The light fixture as recited in claim 1, wherein:

said annular fitter includes a second end and an aperture extending through said second end.

* * * * *